US008943979B2

(12) United States Patent
Gysin et al.

(10) Patent No.: US 8,943,979 B2
(45) Date of Patent: Feb. 3, 2015

(54) MODULAR PALLET

(75) Inventors: Pascal Gysin, Sissach (CH); Bruno Weiss, Wittinsburg (CH)

(73) Assignee: Konsortium Two in One, Sissach (CH)

( * ) Notice: Subject to any disclaimer, the term of this patent is extended or adjusted under 35 U.S.C. 154(b) by 0 days.

(21) Appl. No.: 13/989,412

(22) PCT Filed: Nov. 21, 2011

(86) PCT No.: PCT/IB2011/055215

§ 371 (c)(1), (2), (4) Date: Jul. 25, 2013

(87) PCT Pub. No.: WO2012/073149

PCT Pub. Date: Jun. 7, 2012

(65) Prior Publication Data

US 2014/0000494 A1 Jan. 2, 2014

(30) Foreign Application Priority Data

Dec. 1, 2010 (CH) ..... 2016/10

(51) Int. Cl.
*B65D 19/12* (2006.01)
*B65D 19/00* (2006.01)

(52) U.S. Cl.
CPC ..... *B65D 19/0095* (2013.01); *B65D 19/0006* (2013.01); *B65D 19/0085* (2013.01); *B65D 2519/00273* (2013.01); *B65D 2519/00293* (2013.01); *B65D 2519/00323* (2013.01); *B65D 2519/00333* (2013.01); *B65D 2519/00373* (2013.01); *B65D 2519/00567* (2013.01); *B65D 2519/00985* (2013.01)
USPC ..... 108/56.3

(58) Field of Classification Search
USPC ..... 108/56.1, 53.6, 51.11, 901, 902
See application file for complete search history.

(56) References Cited

U.S. PATENT DOCUMENTS

| | | | | | |
|---|---|---|---|---|---|
| 3,878,796 | A * | 4/1975 | Morrison | 108/56.1 |
| 4,220,099 | A * | 9/1980 | Marchesano | 108/57.19 |
| 4,694,962 | A * | 9/1987 | Taub | 206/600 |
| 5,101,737 | A * | 4/1992 | Gomez | 108/57.18 |
| 5,836,255 | A * | 11/1998 | Uitz | 108/57.25 |
| 5,941,179 | A * | 8/1999 | Herring | 108/57.19 |
| 5,967,056 | A * | 10/1999 | Plante | 108/56.1 |
| 6,105,512 | A * | 8/2000 | Lin | 108/56.3 |
| 6,766,749 | B2 * | 7/2004 | Lacabanne | 108/56.3 |
| 6,837,170 | B2 * | 1/2005 | Taft | 108/57.25 |
| 6,938,558 | B1 * | 9/2005 | Peres | 108/56.3 |
| 6,954,982 | B2 * | 10/2005 | Isle et al. | 29/799 |
| 8,286,563 | B2 * | 10/2012 | Low | 108/56.3 |
| 8,342,106 | B2 * | 1/2013 | Krupka et al. | 108/57.25 |

* cited by examiner

*Primary Examiner* — Jose V Chen

(57) ABSTRACT

A modular pallet constructed from individual parts, to form a transporting pallet or a storage pallet, by using intermediate components of different dimensions, and changeable from a transporting pallet to a storage pallet for use in a high-bay warehouse by moving adapters beneath the transporting rails automatically when entering the high-bay warehouse, and back from a storage pallet to a transporting pallet by removing the adapters again when leaving the high-bay warehouse.

9 Claims, 4 Drawing Sheets

View as seen from viewing direction A

MODULAR PALLET

The present invention relates to a modular pallet according to the preamble of patent claim 1.

Pallets are made in a large number of variants and compete with the so-called Euro pallets made of wood. The Euro pallets, however, still have the most economically viable form, and are used automatically by all consumers, wholesalers and commercial enterprises. Wood appears to be a good material for this purpose which is accepted by all.

The relatively large height of the pallets required, from the point of view of operational reliability, for high-bay storage and reloading proves to be disadvantageous for transporting voluminous and lightweight articles, because they take up a relatively large amount of space. If use is made of wooden pallets, the weight which has to be transported back and forth causes considerable costs.

Known disposable or recyclable pallets are in the form of lightweight pallets which are often not stable enough for being used repeatedly for the rough and reckless tasks of transportation and reloading, when no care is taken. For transportation purposes, it is therefore common practice to use special transporting containers which are lightweight and take up less space. The great disadvantage here is that, between transportation and storage, the articles have to be reloaded from the transporting container onto the standard pallet. The time and effort for this reloading operation is considerable, and the aim is therefore to find possible ways of avoiding the same.

Various concepts, e.g. those presented in GB 2440802, EP1772390, DE20200801200 or CH00301/09, disclose adjustable pallets. These offer the advantage of taking up less space during transportation, but they are very expensive and, for the transportation industry, also constitute a significant additional weight which has to be transported again and again. Further disadvantages of such pallets are their high-outlay mechanics. With rough treatment in logistics/handling, mechanical movable parts are prone to require repair. Therefore, such pallets are not just expensive to buy, but are also expensive to maintain.

These are without any doubt some of the reasons why the old wooden pallet has been used for decades up until now and, being relatively cost-effective to buy, is still the pallet of choice. However, damaged wooden pallets have to be disposed of or incinerated, since otherwise they constitute a significant accident risk. This means that wooden pallets, although very cost-effective to produce, nevertheless become fairly expensive by the time their useful life is at an end. In addition, wooden pallets have a relatively high weight, because they have to be of a sufficiently stable construction for use.

It is an object of the present invention, to design and construct a modular pallet which has the advantages of the universally known wooden pallet, but is more manageable, is more cost-effective to maintain and is produced from recyclable material.

This object is achieved by a modular pallet having the features of patent claim 1. Further features according to the invention are presented in the dependent claims, and the advantages thereof will be explained in the following description.

The figures illustrate possible exemplary embodiments, which will be explained in the following description.

The modular pallet presented is a pallet which consists of interchangeable individual parts produced from recyclable material. The individual parts can be put together differently depending on their use. This makes it possible to produce large numbers of individual parts, which has a cost-lowering effect on the price of the parts.

An important factor for realizing the inventive concept was that of finding the correct recyclable material having the necessary strength. It should be straightforward and cost-effective to process and produce, which applies, for example, to injection molding. Despite good strength, it must not be brittle even at low temperatures. The material has to have, for example, a high impact strength. Furthermore, the creep to which plastics materials are known to be susceptible must not be discernible even at high temperatures. The material should have the desired properties in the temperature range from −20° C. to +50° C. A pallet produced in this way must not rupture, or deform under impact throughout the whole temperature range. If it were to deform, the individual parts could obviously no longer be interchanged, which would not meet the requirements of such modular pallets.

The individual parts are assembled in a form-fitting manner by connections which are shown in the figures in the exemplary form of dovetail connections. Locking means 5, which automatically hook in when the individual parts are being assembled, then secure the same against separating autonomously. Special tools are required in order to allow the locking means 5 of the individual parts which have been damaged, to be released from one another again. Locking means 5 secure the form-fitting connections against opening unintentionally and autonomously. Examples of the connections themselves are dovetail connections, bayonet connections or other coupling-fit connections. The figures show exemplary dovetail connections. The connections become form-fitting and force-fitting connections as a result of the securing locking means 5.

Figure 1:
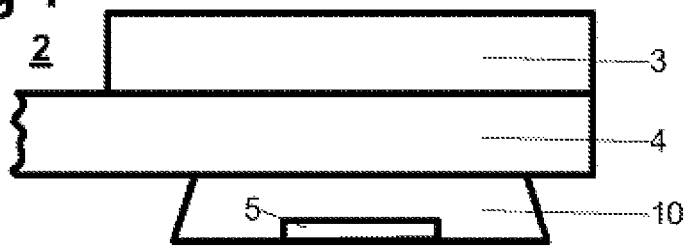
FIG. 1 shows a sectional view of a platform in detail.

The parts according to FIG. 1 are assembled, in principle, as a modular construction system. Each platform 2, irrespective of whether it is equipped with a corresponding substructure 9 to form a transporting pallet or storage pallet, is connected to at least two substructures 9.

The platforms 2 presented here are the same shape for all applications and embodiments, namely a transporting pallet or storage pallet. Possible embodiments of platforms 2 will be described hereinafter.

Figure 2:
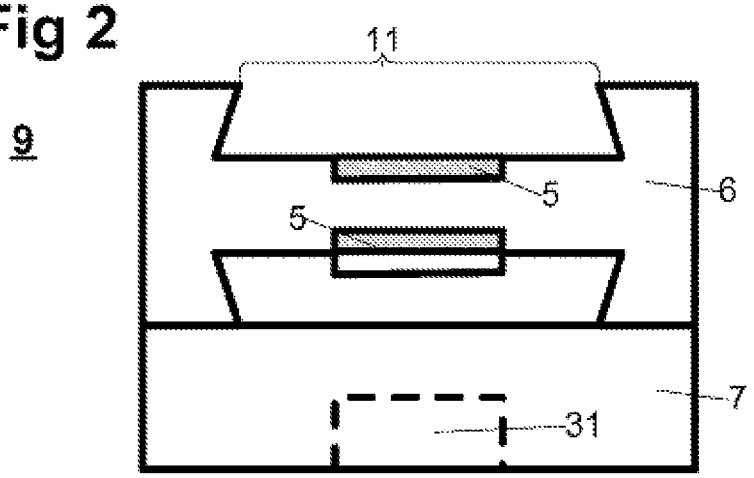
FIG. 2 shows a sectional view of a substructure in detail.

A exemplary platform 2, shown in FIG. 1, as a corner from the viewing direction A (FIG. 2), can be made up of a longitudinal member 3, transverse member 4 and platform tongues 10 by means of releasable connections. In this embodiment, the platform would correspond approximately to the construction and appearance of a wooden pallet which is known at present.

Another embodiment takes the form of the upper parts 3, 4 being made up of a large number of individual parts which are connected to the platform tongue 10 and assembled to form a compact form-fitting and force-fitting platform 2. A further option is that of injection molding a platform 9 in a compact state. The production method selected depends on the material, but also, in particular, on the cost-effectiveness of production. Assembling a large number of individual parts for each individual pallet requires a lot of manual work or high-cost automatic assembly machines. Producing large parts, as constituted by a platform 9 of 120 cm in length and 90 cm in width, is difficult, but not impossible, by injection molding. As far as these outer dimensions are concerned, the relatively small thickness of only a few centimeters presents a particular challenge in the production. Of course, the injection molds which are necessary here are expensive to buy, and the injection-molding machines likewise involve high costs.

A substructure 9 is made up of transporting rail 7, transporting tongue 12 and intermediate component 6. The transporting rail 7 and transporting tongue 12 are injection molded in one piece. The intermediate component 6 may be an individual part. It is also possible, however, for the substructure 9 to be produced in the form of a single molding. The substructure 9 has a transporting groove 13, for connection to the transporting rail 7, and a platform groove 11, for connection to the platform 2. The intermediate component 6 may vary in height H.

Figure 4:
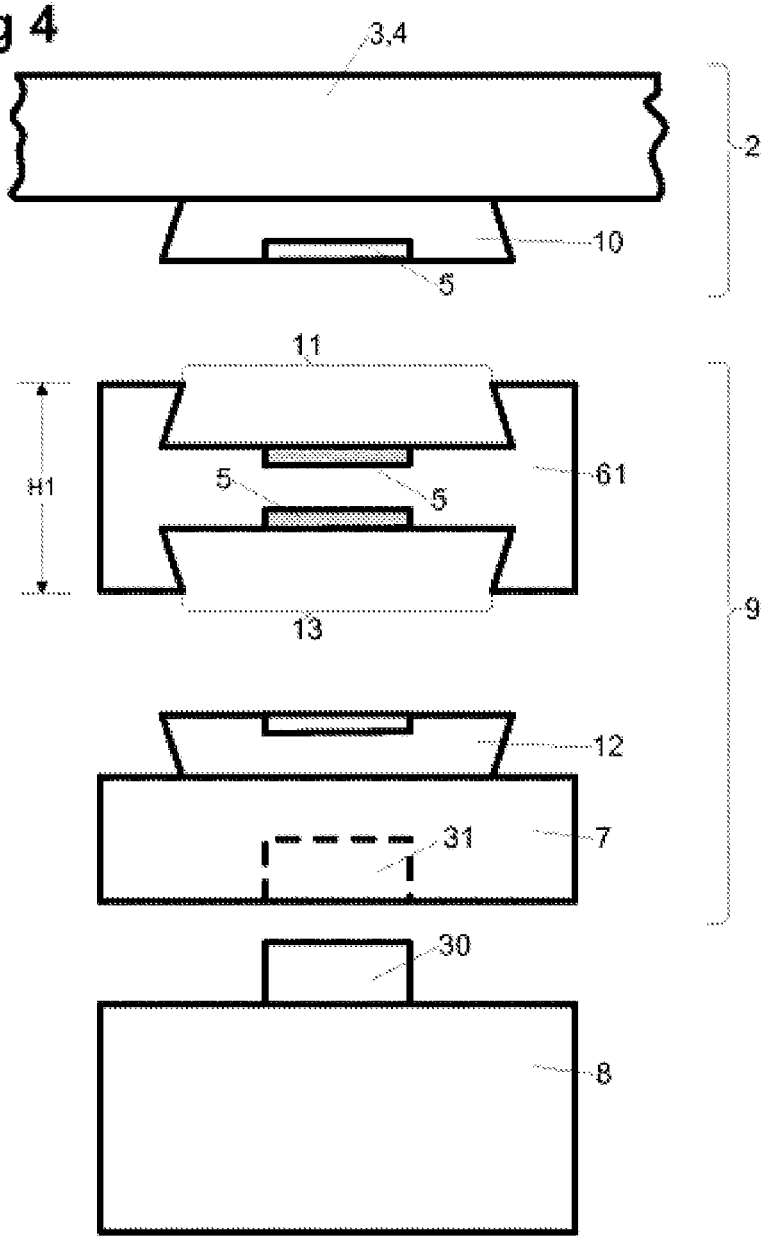
FIG. 4 shows an exploded view, in section, of a transporting pallet.

If the intermediate component 6 has a height H1 (FIG. 4) in the range from 30 mm to 50 mm, with an overall height of 60 mm to 90 mm it takes up less space and is suitable preferably for transportation purposes. During transfer, the free height of the substructure 9 is sufficient in order for the pallet constructed in this way to be reloaded by a fork-lift truck and other common transfer equipment. The intermediate component 6 then becomes the transporting block 61 and, in the context of the present invention, reference is made to a "transporting pallet".

Figure 5:
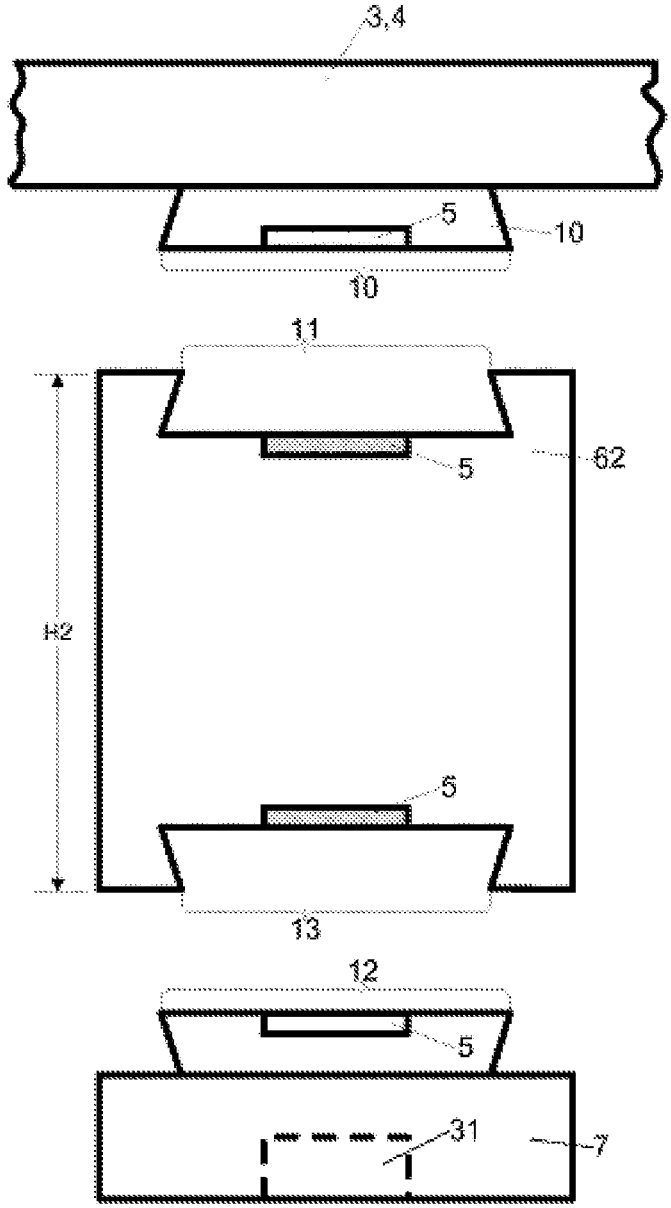
FIG. 5 shows an exploded view, in section, of a storage pallet.

If the intermediate component 6 has a height H2 (FIG. 5) in the range from 50 mm to 100 mm, which results in an overall pallet height of 100 mm to 150 mm, corresponding to a standard pallet, the pallet can be used as a general replacement for the wooden pallets which are used predominantly today. The intermediate component 6 then becomes the storage block 62 and, in the context of the present invention, reference is made to a "storage pallet".

In contrast to the storage pallet, the height of the transporting pallet described above does not meet the requirements of a high-bay warehouse. In order to use this transporting pallet in a high-bay warehouse nonetheless, the transporting rail 7 is equipped with recesses 31. The storage area of the high-bay warehouse supplies so-called HRL adapters 8 (FIG. 4) with stubs 30. Such HRL adapters 8 are automatically moved beneath the transporting rails 7, e.g. from magazines provided for this purpose, in the deposit area of the high-bay warehouse. The stubs 30 of the HRL adapters 8 engage in the recesses 31 of the transporting rails 7, and therefore the free height of the substructure meets the requirements of a high-bay warehouse and the transporting pallet, equipped in the manner just described, can be transported by the apparatuses of the high-bay warehouse. If the transporting pallet is retrieved from the high-bay warehouse, the HRL adapters are automatically removed again into the retrieval region of the high-bay warehouse and placed in the magazines provided for them. The HRL adapters 8 thus do not usually leave the high-bay warehouse.

Figure 3:
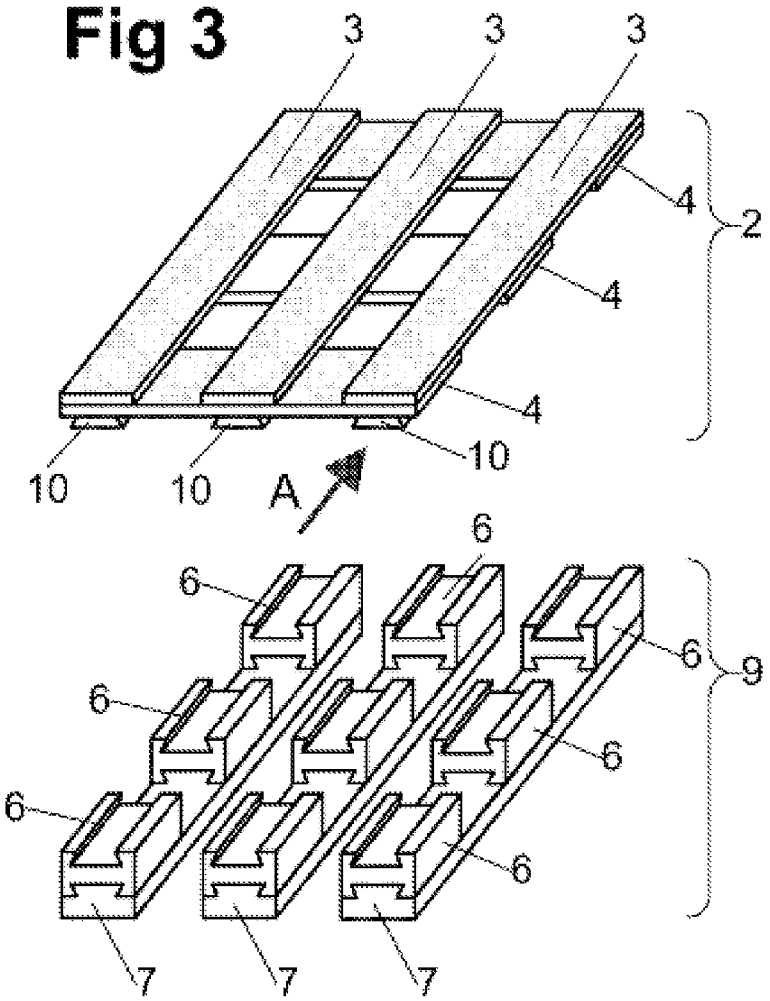
FIG. 3 shows a perspective view of the platform.

The modular system comprises, as described above, a platform 2 and at least two substructures 9. In many cases, and specifically for the construction of a storage pallet, the substructures 9 are arranged beneath a longitudinal member 3 (FIG. 3). Substructures 9 are placed in position irrespective of the manner in which the platform 2 is constructed. In many cases, for voluminous, lightweight articles, it is sufficient to have four short substructures 9 at the corners of the pallet. If lightweight bulk material is involved, for example transported on the pallet in a box, a further substructure 9 may be fitted in the center of the platform.

A substructure 9 comprises at least one transporting rail 7 connected to at least one intermediate component 6. It is possible for the transporting rail 7 and intermediate component 6 to extend over the entire length of the pallet or to form merely short pieces, e.g. blocks. If both the transporting rail 7 and intermediate component 6 extend over the entire length, then at least two substructures 9 should be used along the longitudinal outer edges of the pallet. If the substructure 9 is in the form of short pieces, it is necessary to have at least four such blocks beneath the corners of the platform 2. It is often the case that the transporting rails 7 are the same length as the longitudinal members 3. In contrast, it is always possible for the intermediate components to be short. It is quite conceivable, and probable, for two or three short intermediate components 6 to be arranged between the platform 2 and transporting rail 7, along the length thereof. The entire pallet 1, then, comprises, for example, a platform 2, two or three transporting rails 7 (possibly one in the center) and at least four, six or nine intermediate components 6. The latter case would give the very well-known form of the wooden pallet which is customary today.

FIG. 3 shows the attempt to illustrate platform 2 and three substructures 9. Although this drawing illustrates the platform 2 and the individual substructures 9 in the assembled state, they are made up of the individual parts as described above. It is also possible, however, for the platform 2 and the substructures 9 to comprise injection moldings which are formed directly in one piece. Although it would be quite conceivable for an entire pallet, with platform 2 and the substructures 9, to be molded in one piece, this is absolutely not the concept which corresponds to the modular pallet presented here.

The invention claimed is:

1. A modular pallet having a self-supporting platform (2) which is connected to at least two substructures (9) via form-fitting and force-fitting, but releasable, connections, said platform (2) has platform tongues (10) and a substructure (9) comprising a transporting rail (7) and an intermediate component (6), wherein the intermediate components (6) have a platform groove (11) and a transporting groove (13) and the transporting rail (7) has a transporting tongue (12), wherein the intermediate component (6) and transporting rail (7) are connected to one another in a form-fitting and releasable manner via a transporting groove (13) and a transporting tongue (12), wherein:

the transporting rail (7) has recesses (31) and HRL adapters (8) have stubs (30) form-fitting and engaging in the recesses (31) when HRL adapters (8) are moved beneath the transporting rail (7).

2. The modular pallet as claimed in claim 1, wherein the platform (2) comprises at least three longitudinal members (3) and at least three transverse members (4), which are connected to one another in a form-fitting and releasable manner, wherein at least two transverse members (4) have platform tongues (10), which are connected to the transverse members (4) in a formfitting and releasable manner.

3. The modular pallet as claimed in claim 1, wherein the platform (2) comprises a large number of individual parts which are connected to one another in a formfitting and force-fitting manner.

4. The modular pallet as claimed in claim 1, wherein the platform (2) is formed in one piece.

5. The modular pallet as claimed in claim 1, wherein the intermediate components (6) have an overall height (H1) of 30 mm to 50 mm.

6. The modular pallet as claimed in claim 1, wherein the intermediate components (6) have an overall height (H1) of 50 mm to 100 mm.

7. The modular pallet as claimed in claim 1 or claim 2, wherein all the connections between the longitudinal member (3), transverse member (4), intermediate component (6) and transporting rail (7) are secured in a form-fitting manner by connections and in a force-fitting manner by way of a locking means (5).

8. The modular pallet as claimed in claim 1 or claim 3, wherein the individual parts are secured in a form-fitting manner by means of connections and in a force-fitting manner by way of locking means (5).

9. The modular pallet as claimed in claim 1, wherein the substructure (9), comprising the intermediate component (6) and transporting rail (7) is formed in one piece.

* * * * *